US007129903B2

(12) United States Patent
Desargant et al.

(10) Patent No.: US 7,129,903 B2
(45) Date of Patent: Oct. 31, 2006

(54) METHOD AND APPARATUS FOR MOUNTING A ROTATING REFLECTOR ANTENNA TO MINIMIZE SWEPT ARC

(75) Inventors: Glen J. Desargant, Fullerton, CA (US); Albert Louis Bien, Anaheim, CA (US)

(73) Assignee: The Boeing Company, Chicago, IL (US)

( * ) Notice: Subject to any disclaimer, the term of this patent is extended or adjusted under 35 U.S.C. 154(b) by 60 days.

(21) Appl. No.: 10/916,886

(22) Filed: Aug. 12, 2004

(65) Prior Publication Data

US 2005/0068241 A1 Mar. 31, 2005

Related U.S. Application Data

(63) Continuation-in-part of application No. 09/965,668, filed on Sep. 27, 2001, now Pat. No. 6,861,994.

(51) Int. Cl.
*H01Q 13/00* (2006.01)

(52) U.S. Cl. ..... 343/781 CA; 343/781 P

(58) Field of Classification Search ..... 343/781 P, 343/781 CA

See application file for complete search history.

(56) References Cited

U.S. PATENT DOCUMENTS

| | | | | |
|---|---|---|---|---|
| 2,421,593 A | | 6/1947 | Bishop | 343/761 |
| 2,427,005 A | | 9/1947 | King | 343/762 |
| 3,860,930 A | | 1/1975 | Peterson | 343/705 |
| 4,034,378 A | * | 7/1977 | Ohm | 343/781 CA |
| 4,786,912 A | * | 11/1988 | Brown et al. | 343/761 |
| 5,075,680 A | * | 12/1991 | Dabbs | 342/52 |
| 5,714,947 A | * | 2/1998 | Richardson et al. | 340/903 |
| 5,835,057 A | | 11/1998 | van Heyningen | 342/359 |
| 6,184,840 B1 | * | 2/2001 | Hsin-Loug et al. | 343/781 P |
| 6,307,521 B1 | * | 10/2001 | Schindler et al. | 343/781 CA |

OTHER PUBLICATIONS

A Satellite-Tracking K- and Ka-Band Mobile Vehicle Antenna System dated Nov. 1993, Authors Arthur C. Densmore and Vahraz Jamnejad, 9 pages.

International Search Report for PCT/US 02/ 28740, 4 pages, no dated provided!.

* cited by examiner

*Primary Examiner*—Tho Phan
(74) *Attorney, Agent, or Firm*—Harness Dickey & Pierce P.L.C.

(57) ABSTRACT

An apparatus and method for forming a cassegrain reflector antenna that allows an extended length feed horn to be employed without increasing an overall depth of the antenna. This enables the swept diameter of the antenna to be maintained at a minimum comparable to an antenna system using a standard length feed horn. The antenna system employs a hole at a vertex of the main reflector of the antenna system. The elongated feed horn is mounted at the vertex such that a major portion of its length projects outwardly form a rear surface of the main reflector. Antenna electronics components can be mounted on a neck of the feed horn or alternatively on a rear surface of the main reflector. Since the elongated feed horn does not increase the overall depth, and thus the swept arc of the antenna, the size of the radome needed to cover the antenna can be kept to a minimum size comparable to that required for reflector antennas employing conventional, standard length feed horns.

7 Claims, 6 Drawing Sheets

FIG 1
PRIOR
ART
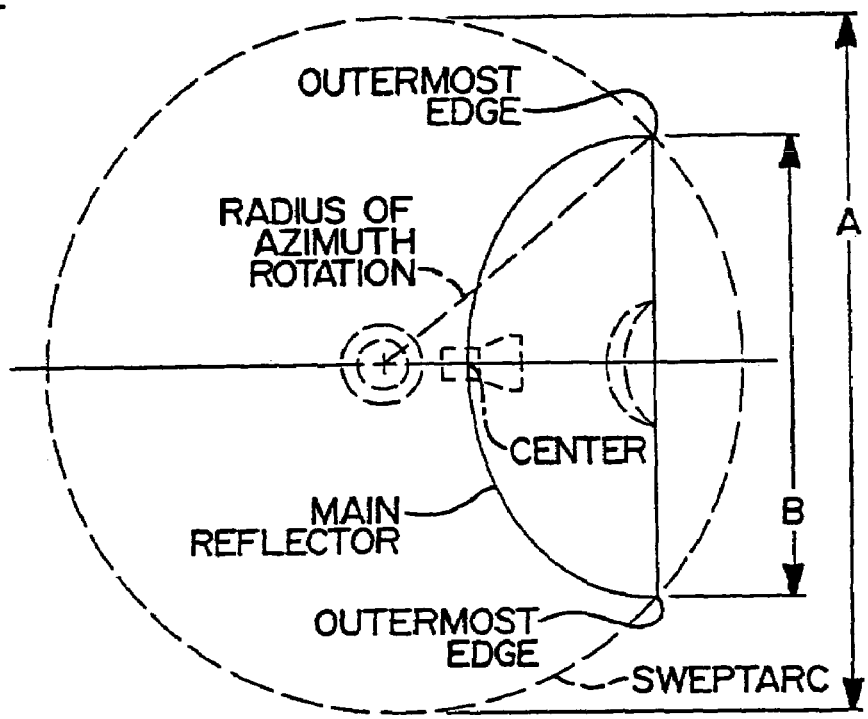
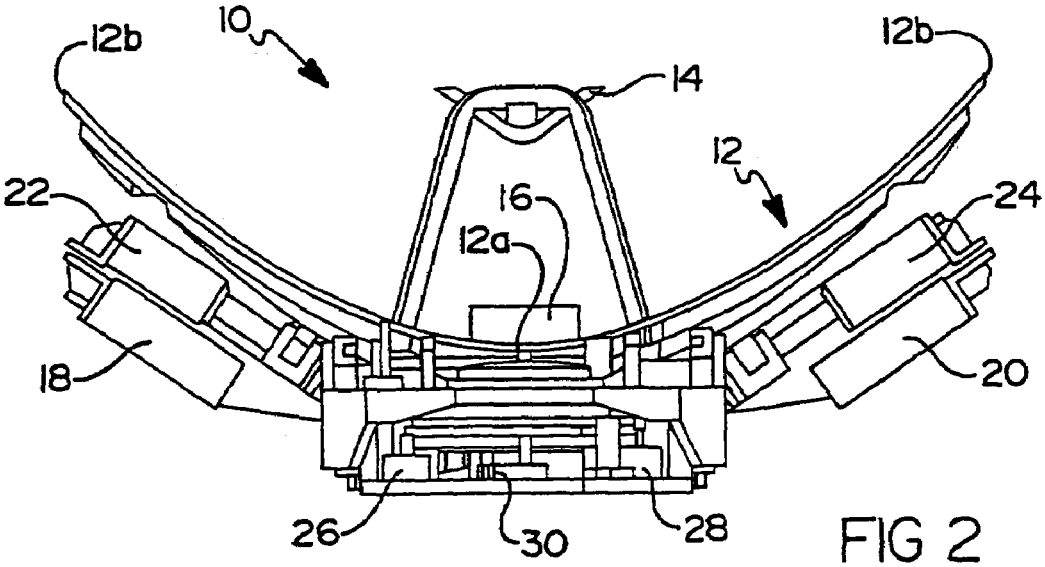
FIG 2
PRIOR
ART

FIG 5
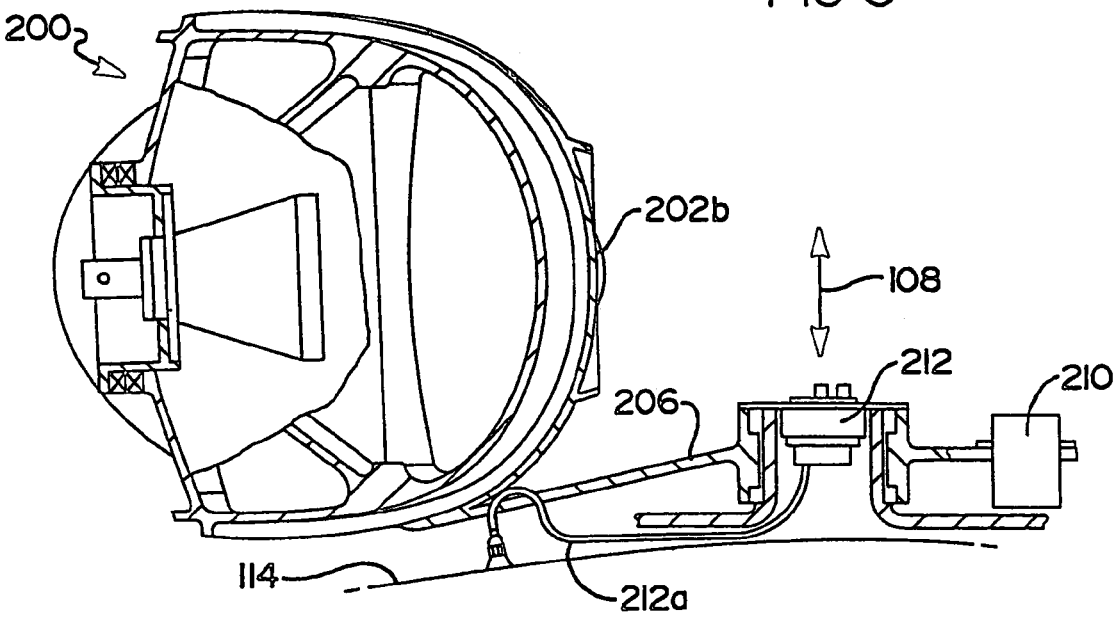
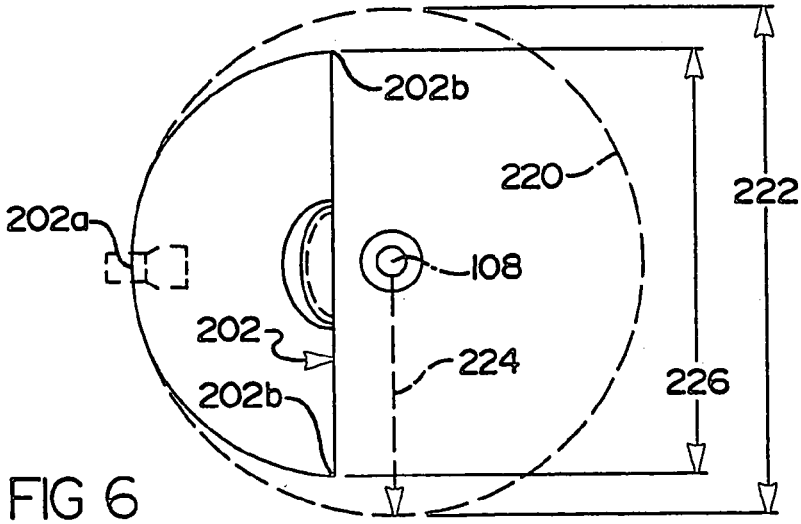
FIG 6

FIG 7
PRIOR ART
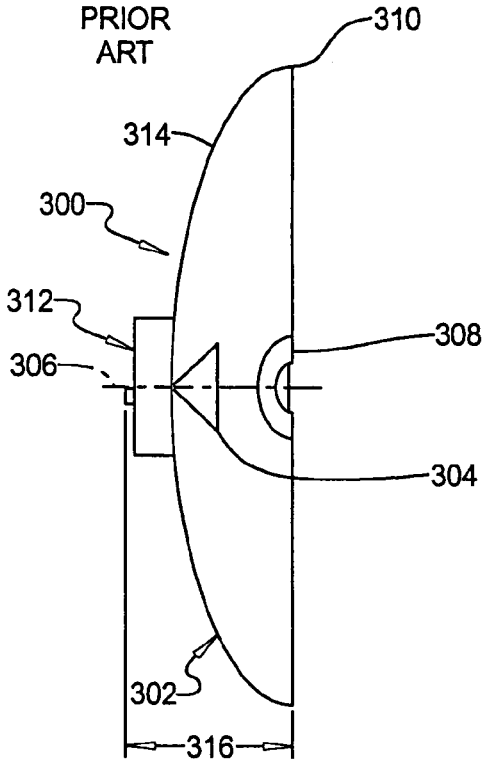
FIG 8
PRIOR ART
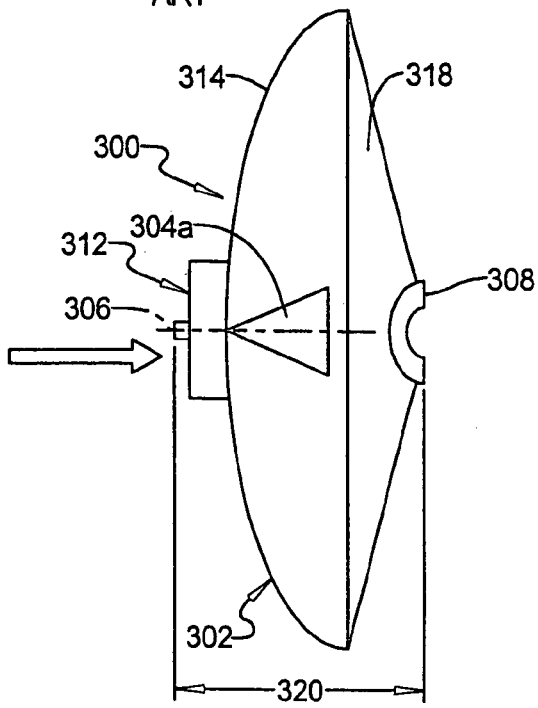
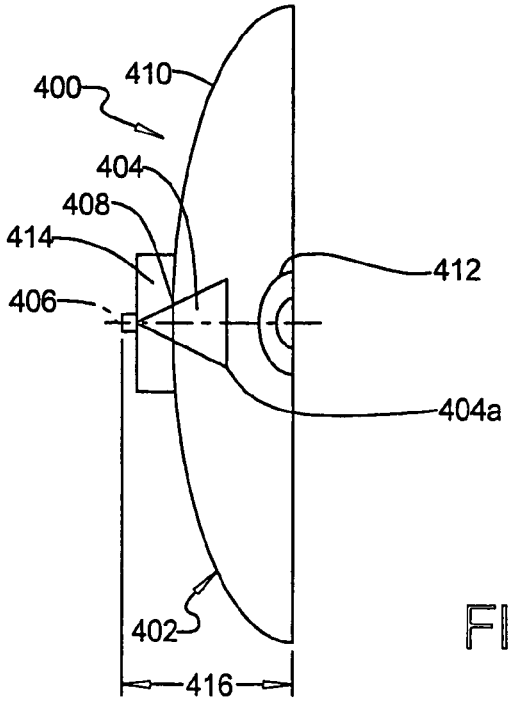
FIG 9

METHOD AND APPARATUS FOR MOUNTING A ROTATING REFLECTOR ANTENNA TO MINIMIZE SWEPT ARC

CROSS-REFERENCE TO RELATED APPLICATIONS

This application is a continuation-in-part of U.S. patent application Ser. No. 09/965,668 filed on Sep. 27, 2001 now U.S. Pat. No. 6,861,994, entitled "Method and Apparatus For Mounting a Rotating Reflector Antenna to Minimize Swept Arc", presently pending, the disclosure of which is incorporated herein by reference.

FIELD OF THE INVENTION

The present invention relates to antenna systems, and more particularly to a method and apparatus for mounting a reflector antenna in such a manner as to minimize the swept arc of the antenna when the antenna is rotated about its azimuthal axis.

BACKGROUND OF THE INVENTION

The frontal surface area of an antenna mounted on an aircraft, under a radome, is of critical importance with respect to the aerodynamics of the aircraft. This is because of the drag created by the radome and the resulting effects on aircraft performance and fuel consumption. With reflector antennas that must be rotated about their azimuthal axes, the "swept arc" of the antenna is larger than the overall width of the main reflector of the antenna. This necessitates a commensurately wide radome, thus increasing the frontal surface area of the radome and consequently increasing the drag on the aircraft.

Referring to FIG. 1, the diameter of a swept arc "A" of a main reflector of a prior art antenna system can be seen when the azimuthal axis of rotation is located rearwardly, or behind, an axial center of the main reflector, as is conventional with present day reflector antenna systems. The outermost edges of the main reflector are also noted. This diameter is noted by dimension "B". The diameter of the swept arc produced by the main reflector is considerably larger than the diameter of the main reflector itself when the azimuthal axis of rotation is located at, or rearwardly of, the center of the main reflector.

It is therefore extremely important that the height and width (i.e. depth) of a reflector antenna be held to the minimum dimensions consistent with the required electromagnetic performance of the antenna. More particularly, it is important for the main reflector of an antenna intended to be mounted on an outer surface of an aircraft, to be mounted in such a manner that the swept arc of the antenna is minimized when the antenna is rotated about its azimuthal axis. Minimizing the swept arc of the antenna would thus minimize the dimensions of the radome required to cover the antenna, and thereby minimize the corresponding drag created by the radome while an aircraft on which the radome is mounted is in flight.

Still another consideration in minimizing the swept arc is the physical length of the feed horn mounted at the axial center of the reflector (i.e., at the vertex). To maximize antenna performance, in some instances it would be desirable to use a longer feed horn on the reflector. However, using the longer than typical length feed horn necessitates increasing the depth of the reflector itself. Increasing the overall depth of the reflector means increasing its overall diameter or aperture size, and thus increasing its swept arc. Thus, there exists a need for a reflector antenna design that allows the use of an elongated feed horn which can be integrated into the reflector of the antenna without requiring an increase in the depth and the overall aperture size of the antenna.

SUMMARY OF THE INVENTION

The above drawbacks are addressed by an antenna system in accordance with a preferred embodiment of the present invention. The antenna system comprises a main reflector having an opening formed at its vertex. An elongated feed horn is disposed in the opening such that a major portion of the length of the feed horn extends outwardly of a rear surface of the main reflector. Antenna electronics components used with the antenna may be mounted on the portion of the feed horn projecting from the rear surface of the main reflector or on the rear surface of the main reflector itself. By mounting the feed horn such that a major portion of its length extends through the hole in the reflector, and thus outwardly of the rear surface of the reflector, the need to increase the depth of the reflector itself, and thus the overall aperture size of the antenna, is eliminated.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein:

FIG. 1 is a simplified diagram of the swept arc produced by a prior art mounting arrangement wherein the azimuthal axis of rotation of the main reflector is disposed slightly rearwardly of the center of the main reflector;

FIG. 2 is a plan view of a prior art reflector antenna, wherein the main reflector of the antenna has center outermost edge portions.

FIG. 5 is a side view of the antenna system of the present invention located with the azimuthal axis disposed in a plane located forwardly of the outermost edges of the main reflector of the antenna system;

FIG. 6 is a diagram of the swept arc produced by the antenna system shown in FIG. 5;

FIG. 7 illustrates a present day, low profile cassegrain reflector having a feed horn with an antenna electronics components mounted at the rear surface of the main reflector;

FIG. 8 illustrates the antenna of FIG. 7 but with an elongated feed horn, and also illustrating the increase in overall depth of the antenna;

FIG. 9 illustrates a cassegrain reflector antenna in accordance with a preferred embodiment of the present invention;

DETAILED DESCRIPTION OF THE PREFERRED EMBODIMENTS

Figure 3:
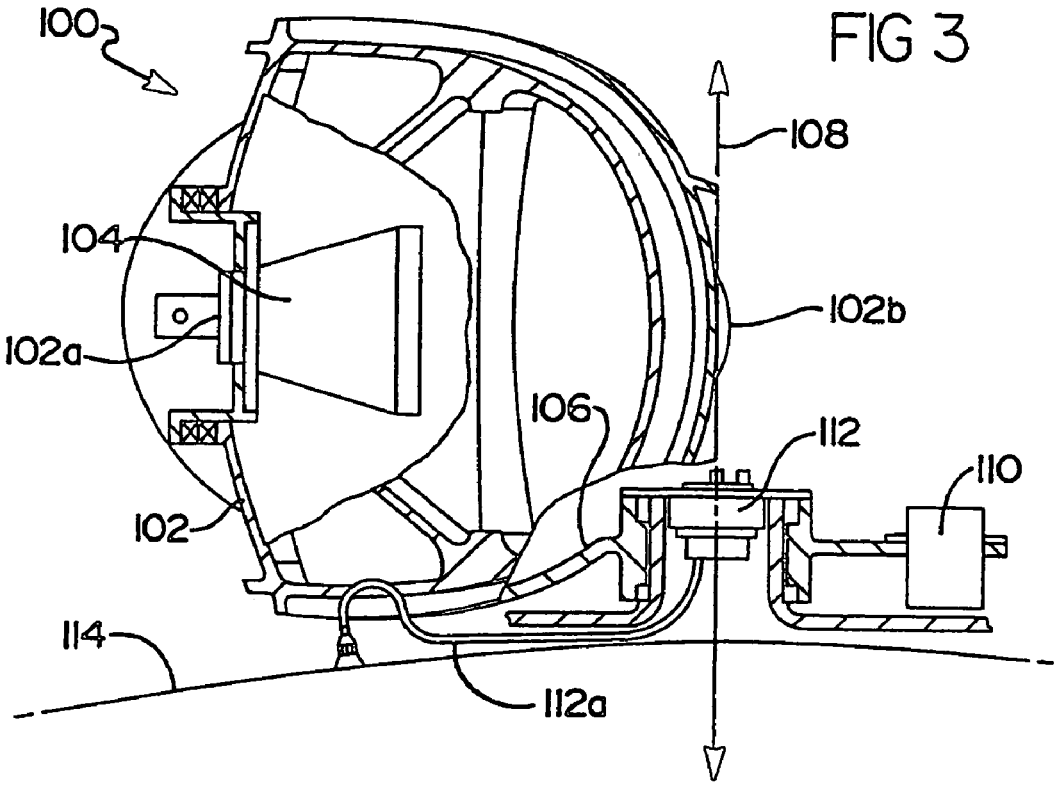
FIG. 3 is a side view of an antenna system in accordance with a preferred embodiment of the present invention illustrating the azimuthal axis located within a plane extending between the outermost edges of the main reflector of the antenna.

The following description of the preferred embodiment(s) is merely exemplary in nature and is in no way intended to limit the invention, its application, or uses.

Referring to FIG. 2, a prior art antenna system 10 well suited to be mounted on an external surface of an aircraft is shown. The antenna system 10 includes a main reflector 12 having a center 12*a* and outermost edge portions 12*b*. A subreflector 14 is positioned forwardly of a feed horn 16 located at the center 12*a* of the main reflector 12. A pair of low noise amplifiers (LNA) 18 and 20 are used, as are a pair of diplexers 22 and 24, for performing signal conditioning operations on the received and transmitted signals. An elevation motor 26 is used to position the main reflector 12 at a desired elevation angle, while an azimuth motor 28 is used to rotate the main reflector 12 about an azimuthal axis to position the main reflector at a desired azimuth angle. An encoder 30 is used to track the azimuth angle of the main reflector 12 and to provide feedback to the azimuth motor 28.

Referring now to FIG. 3, an antenna system 100 in accordance with a preferred embodiment of the present invention is illustrated. The antenna system 100 is similar to antenna system 10 by the use of a main reflector 102 having an axial center 102*a* and outermost lateral edge portions 102*b*. A feed horn 104 is disposed at the center 102*a* of the main reflector 102. The main reflector 102 is supported on a platform 106 which places the azimuth axis of rotation 108 of the main reflector 102 in a plane which extends through the outermost edges 102*b* of the main reflector. The platform 106 is rotated about the azimuthal axis of rotation 108 by an azimuth motor 110 to thus position the main reflector 102 at a desired azimuth angle. A two channel coaxial rotary joint 112 is preferably employed to enable the necessary electrical connections between the feed horn 104 and a transmission line 112*a* which extends through an outer surface 114 of an aircraft. For simplicity, the radome which would ordinarily enclose the entire antenna system 100 has not been shown.

Figure 4:
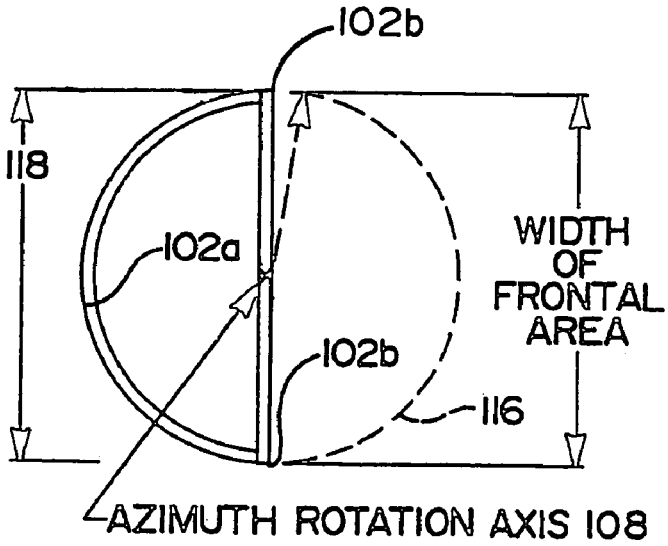
FIG. 4 is a diagram illustrating the swept arc produced by locating the azimuthal axis of rotation as shown in FIG. 3.

Referring to FIG. 4, a swept arc 116 is shown which is produced by rotational movement of the main reflector 102, shown in highly simplified form, of the antenna system 100. When the azimuthal axis of rotation 108 is located such that it extends through the outermost lateral edges 102*b* of the main reflector 102, as described in connection with FIG. 3, the radius of the swept arc 116 is approximately one-half that of the overall length 118 of the reflector 102. Thus, locating the azimuthal axis of rotation 108 forwardly of the center 102*a* of the main reflector 102 (i.e., to the right of center point 102*a* in FIG. 3) dramatically reduces the swept arc produced by the main reflector. This reduction in the overall area, and volume, of the swept arc is also visible from a comparison of FIGS. 1 and 4.

The antenna system 100 shown in FIG. 3, however, in some applications, may result in an unacceptable degree of blockage of the signal being transmitted and/or received by the antenna system 100. Accordingly, it may be desirable to locate the azimuthal axis of rotation 108 shown in FIG. 3 forwardly of the outermost edges 102*b* of the main reflector 102. Such a mounting arrangement is shown in FIG. 5. Antenna system 200 shown in FIG. 5 is identical with antenna system 100 shown in FIG. 3 with the exception that mounting platform 206 has a longer overall length to allow the azimuthal axis or rotation 108 to be located forwardly (i.e., to the right in FIG. 5) of the outermost edges 202*b* of the main reflector 202. It will also be appreciated that components of the antenna system 200 in common with those of antenna system 100 have been designated by reference numerals increased by a factor of 100 over those used to denote the components of the antenna system 100. The swept arc produced by the antenna system 200 is shown in FIG. 6. The swept arc is designated by dashed circle 220. The maximum, effective frontal width of the main reflector 202 is thus represented by arrow 222, which is only slightly larger than a diameter 226 of the main reflector. The radius of rotation of the reflector 202 is represented by line 224. Comparing the swept arc 220 of FIG. 6 with the swept arc 116 illustrated in FIG. 4, it can be seen that the swept arc produced by the mounting arrangement of antenna system 200 is slightly greater than that produced by antenna system 100. However, the location of the azimuthal axis forwardly of the outermost edges 202*b* of the main reflector 202 helps to eliminate a degree of the blockage produced by the mounting platform 206 and the rotary joint 212.

Referring to FIG. 7, there is shown a conventional cassegrain reflector antenna for the purpose of illustrating the problem of increasing the depth of the antenna when the feed horn length is increased. The antenna 300 includes a main reflector 302 having a feed horn 304 mounted at a vertex 306 of the main reflector 302. A subreflector 308 is mounted at an outermost edge 310 of the main reflector 302 that forms the aperture of the antenna 300. An antenna electronics subassembly or subassemblies 312 may be mounted on a rear surface 314 of the main reflector 302. The overall depth of the antenna 300 is designated by arrow 316.

Referring to FIG. 8, when an elongated, moderate flare angle feed horn 304*a* is employed, the subreflector 308 must be moved outwardly of the main reflector 302. The subreflector 308 is typically held by two or more struts 318 so as to be concentric with the vertex 306 of the main reflector 302. The overall depth of the antenna 300 is represented by arrow 320. As will be appreciated from FIGS. 7 and 8, the depth of the antenna 300 increases significantly when an elongated feed horn 304*a* is employed. This increases the swept arc of the antenna, which in turn necessitates a larger radome for covering the antenna when the antenna is employed on an external surface of a high speed mobile platform. The larger radome contributes to reduced aerodynamic efficiency of the mobile platform.

Referring to FIG. 9, an antenna 400 in accordance with a preferred embodiment of the present invention is illustrated. Antenna 400 includes a main reflector 402 having an elongated feed horn 404 disposed at an axial center (i.e., vertex) 406 of the main reflector 402. A hole 408 is formed in the main reflector to allow a major portion of the length of the feed horn 404 to project outwardly from a rear surface 410 of the main reflector 402. A subreflector 412 is disposed at the vertex 406 of the main reflector 402 and supported by one or more struts (not visible). An antenna electronics subassembly 414 may be supported on the rear surface 410 of the main reflector 402 or on a neck portion 405 of the feed horn 404. The antenna electronics 414 may comprise an ortho mode transducer, low noise amplifiers, or other components.

Figure 10:
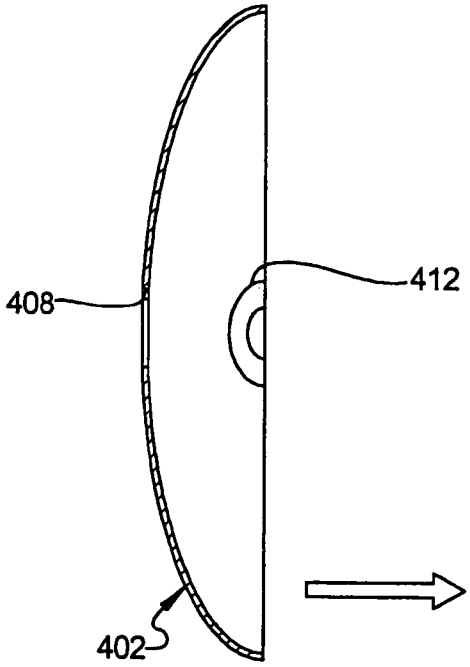
FIG. 10 illustrates only the main reflector and subreflector of the antenna of FIG. 9 but showing a hole formed at the vertex of the main reflector.
Figure 11:
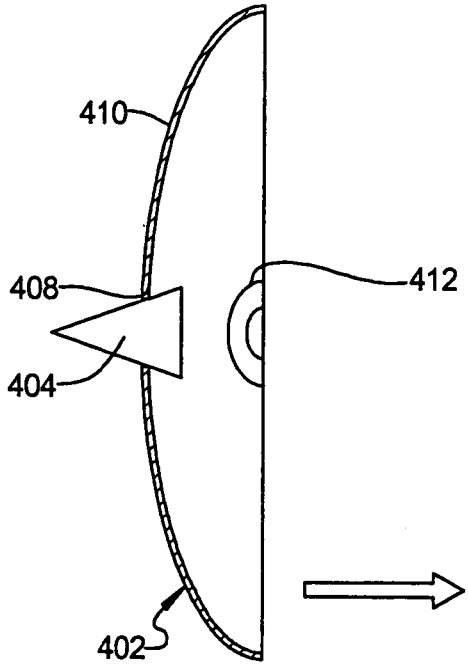
FIG. 11 shows the feed horn projecting through the hole in the main reflector of the antenna.

With brief reference to FIGS. 10 and 11, the hole 408 in the main reflector 402 can be seen in even greater detail. The hole 408 should be of sufficient diameter to permit a desired portion, preferably about 50%, of the feed horn 404 to project therethrough. The larger the diameter of the hole 408, the greater the portion of the feed horn 404 that will be able to project through the hole 408. In one preferred form the feed horn comprises an overall length of about six inches (152.4 mm) and has a diameter at its forward end 404*a* of about three inches (76.2 mm). A more traditional feed horn, such as feed horn 304 in FIG. 7, has a diameter of about 3–5 inches (76.2 mm–127 mm) at its forward end and an overall length of about three inches. The hole 408 in the main reflector is preferably made slightly larger than what might be actually needed to permit a degree of longitudinal adjustment of the feed horn 404 relative to subreflector 412.

The use of an elongated feed horn with a narrower forward end produces a more focused, near-field illumination of the subreflector 412. In practice, the overall length of the feed horn 404 will typically be between 20%–100% greater than the length of a standard, wide angle feed horn such as feed horn 304.

Referring to FIG. 9, arrow 416 represents the overall depth of the antenna 400. The depth 416 is significantly less than the depth indicated by arrow 320 in FIG. 8, and substantially the same as the depth indicated by arrow 316 in FIG. 7. Thus, the overall swept volume of the antenna 400 will be less than that produced by the antenna of FIG. 8, and substantially the same as that produced by antenna 300 in FIG. 7.

The use of the hole 408 in the main reflector 402 thus allows an elongated feed horn 404 to be employed that even better disperses electromagnetic wave energy onto the subreflector 412, but without incurring the penalty of increasing the overall depth of the antenna 400. This allows the swept arc of the antenna 400 to be minimized, which contributes to maintaining aerodynamic efficiency when the antenna 400 is covered by a radome and disposed on a fast moving mobile platform.

Figure 12:
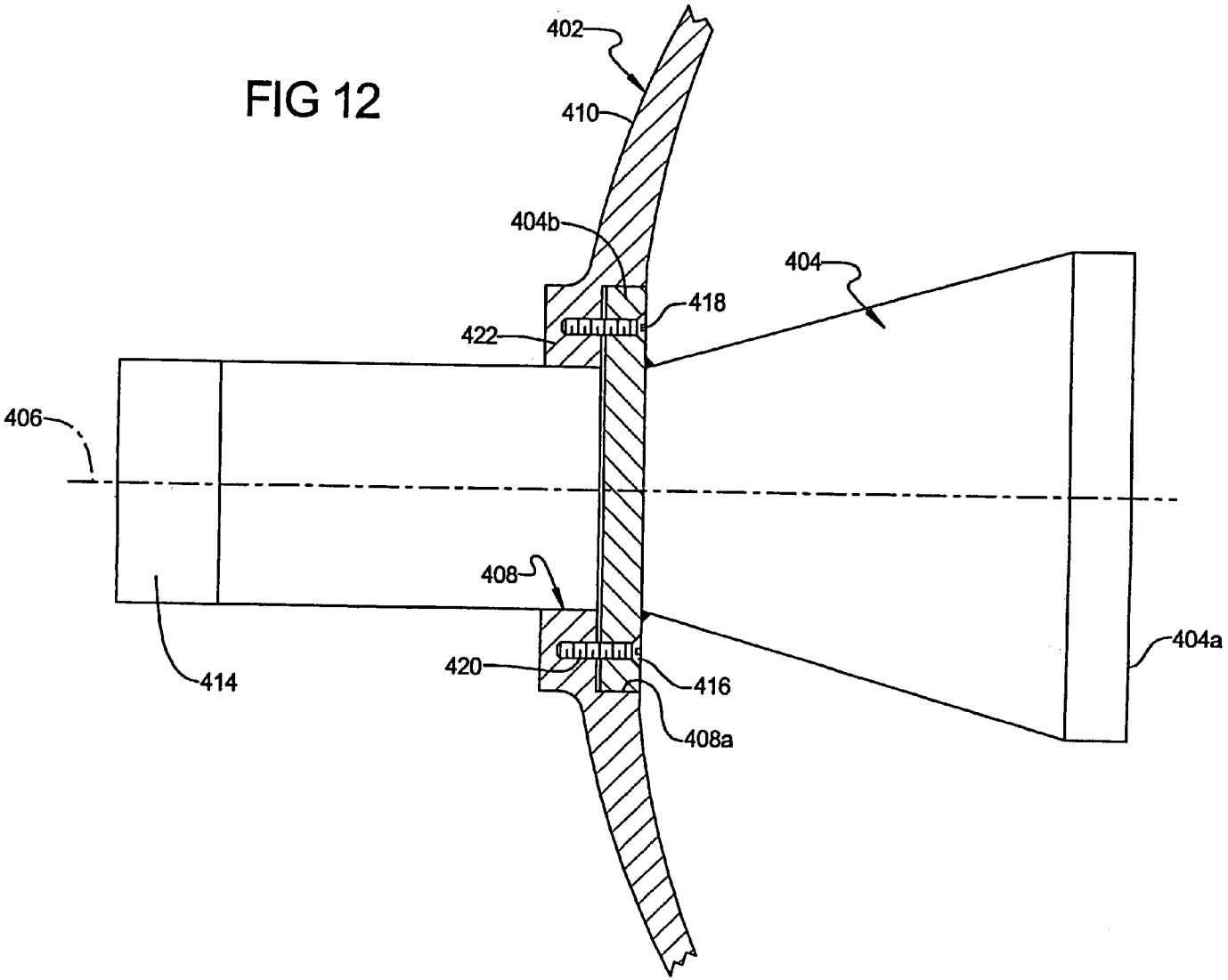
FIG. 12 is an enlarged side cross sectional view of a portion of the main reflector showing the attachment of the feed horn thereto.

Referring to FIG. 12, an enlarged portion of the main reflector 402 and the feed horn 404 is shown. The reflector hole 408 includes a counterbored area 408*a* which houses a flange 404*b* of the feed horn 404. A plurality of screws 418 are used to secure the flange 404*b* in the counterbored area 408*a*. The screws 418 engage in blind threaded holes 420 formed in a boss portion 422 that surrounds the vertex 406 of the main reflector 402. One or more washers or shims can be placed over the threaded screws 418 to adjust the longitudinal positioning of the feed horn 404 relative to the subreflector 412.

It will also be appreciated that both the main reflector 402 and the subreflector 412 are preferably "shaped" as needed to achieve the desired performance for the antenna 400. The overall length of the feed horn 404, its diameter at the forward end 404 and its spacing from the subreflector 412 are all factors that are taken into account in determining the optical shape of the main reflector 402 and the optimal shape of the subreflector 404.

The preferred embodiments of the present invention thus provide a means for supporting a reflector antenna in a manner which minimizes the effective frontal area of the reflector antenna, and thus allows a radome having a smaller frontal area to be employed in covering the antenna when the antenna is located on an outer surface of an aircraft. The preferred embodiments do not significantly complicate the construction of the antenna system nor do they complicate the mounting of the antenna system on the outer surface of an aircraft. Furthermore, the preferred embodiments do not significantly add to the costs of construction of the antenna systems.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification and following claims.

What is claimed is:

1. A reflector antenna comprising:

a main reflector having a hole at a vertex and an outer peripheral edge defining an aperture, said vertex lying along a longitudinal axis defining a coaxial center of said main reflector;

a feed horn mounted at said vertex such that a first portion of said feedhorn projects through the hole rearwardly of said vertex, and a second portion projects forwardly of said vertex;

a subreflector supported forwardly of said main reflector; and said main reflector being supported for rotational movement about an axis disposed perpendicular to said longitudinal axis and between said vertex and said subreflector, to thus minimize a swept arc of said main reflector during rotation.

2. The reflector antenna of claim 1, wherein approximately 50 percent of an overall length of the main reflector projects through the hole.

3. The antenna of claim 1, further comprising an antenna electronics subassembly supported from a rear surface of the main reflector adjacent the vertex of the main reflector.

4. A reflector antenna comprising:

a main reflector having a hole at a vertex and an outer peripheral edge defining an aperture, said vertex lying along a longitudinal axis defining a coaxial center of said main reflector;

a feed horn mounted at said vertex such that a first portion of said feedhorn projects through the hole rearwardly of said vertex, and a second portion projects forwardly of said vertex;

a subreflector supported forwardly of said main reflector;

said main reflector being supported for rotational movement about an azimuthal rotational axis disposed perpendicular to said longitudinal axis; and said azimuthal rotational axis being located at a point along said longitudinal axis forwardly of said vertex, to minimize a swept arc of said main reflector antenna during rotation.

5. The reflector antenna of claim 4, wherein said azimuthal rotational axis is located at a point forwardly of said vertex but rearwardly of said aperture of said main reflector.

6. The reflector antenna of claim 4, wherein a position of said feed horn is adjustable relative to said vertex.

7. A reflector antenna comprising:

a main reflector having a hole at a vertex and an outer peripheral edge defining an aperture, said vertex lying along a longitudinal axis defining a coaxial center of said main reflector;

a feed horn mounted at said vertex such that a first portion of said feedhorn projects through the hole rearwardly of said vertex, and a second portion projects forwardly of said vertex;

a subreflector supported forwardly of said main reflector;

said main reflector being supported for rotational movement about an azimuthal rotational axis disposed perpendicular to said longitudinal axis;

said feedhorn being adjustably positionable relative to said vertex; and said azimuthal rotational axis being located at a point along said longitudinal axis forwardly of said vertex, to minimize a swept arc of said main reflector during rotation.

* * * * *